US009765540B2

(12) United States Patent
Maunder et al.

(10) Patent No.: US 9,765,540 B2
(45) Date of Patent: Sep. 19, 2017

(54) HOLE REPAIR

(71) Applicant: Corehole Solutions Pty Ltd, Paradise Waters (AU)

(72) Inventors: Anthony Maunder, Paradise Waters (AU); Jack Davies, Mosman (AU)

( * ) Notice: Subject to any disclaimer, the term of this patent is extended or adjusted under 35 U.S.C. 154(b) by 0 days.

(21) Appl. No.: 15/029,628

(22) PCT Filed: Oct. 16, 2014

(86) PCT No.: PCT/AU2014/000974
§ 371 (c)(1),
(2) Date: Apr. 15, 2016

(87) PCT Pub. No.: WO2015/054727
PCT Pub. Date: Apr. 23, 2015

(65) Prior Publication Data

US 2016/0265241 A1 Sep. 15, 2016

(30) Foreign Application Priority Data

Oct. 16, 2013 (AU) ..... 2013903990

(51) Int. Cl.
*E04G 23/02* (2006.01)

(52) U.S. Cl.
CPC ..... *E04G 23/0288* (2013.01); *E04G 23/0203* (2013.01); *E04G 23/024* (2013.01); *E04G 23/0218* (2013.01); *E04G 23/0229* (2013.01)

(58) Field of Classification Search
CPC ..... E04G 23/0288; E04G 23/024; E04G 23/0229; E04G 23/0218; E04G 23/0203; E04G 23/0211; E04G 23/0214
See application file for complete search history.

(56) References Cited

U.S. PATENT DOCUMENTS 1,907,811 A * 5/1933 Hollos ..... E02D 5/801 52/156
2,128,480 A * 8/1938 Wertz ..... E04G 23/0203 404/135
2,851,135 A * 9/1958 Woodruff, Sr. ..... E02D 5/805 248/508
3,629,928 A * 12/1971 Hammerle ..... B22D 7/066 249/174
3,676,965 A * 7/1972 Deike ..... E02D 5/801 52/157
3,680,274 A * 8/1972 Deike ..... E02D 5/801 405/237
4,100,712 A * 7/1978 Hyman ..... E04G 23/0203 428/63
4,270,318 A * 6/1981 Carroll ..... H02G 3/185 52/1
4,354,332 A * 10/1982 Lentz ..... E04G 23/0203 264/36.15

(Continued)

*Primary Examiner* — Brent W Herring
(74) *Attorney, Agent, or Firm* — Eagar & Martin Pty Ltd

(57) ABSTRACT

A hole repair assembly includes a support. A connector is fastenable to the support. A closure can connect to the support with the connector. The support, connector and closure are configured so that the support and the closure can be connected and spaced from each other with the connector. One or more retaining members are arranged on one or both of the support and the connector to extend from the connector.

15 Claims, 5 Drawing Sheets

(56) References Cited

U.S. PATENT DOCUMENTS 4,406,107 A * 9/1983 Schoonbeck ..... E04G 23/0203 52/514
4,432,465 A 2/1984 Wuertz et al.
4,465,648 A * 8/1984 Kiriyama ..... C21B 7/06 249/94
5,033,949 A * 7/1991 Jewett ..... E04G 23/0203 264/30
5,269,114 A * 12/1993 Albers ..... E04G 13/00 52/127.7
5,881,523 A * 3/1999 Quatrochi, Jr. ..... E04G 23/0203 52/514.5
5,954,095 A * 9/1999 Grigory ..... F16L 55/168 138/94
6,317,952 B1 11/2001 Vogt et al.
6,948,289 B2 * 9/2005 Bravinski ..... E04B 2/8647 249/187.1
7,121,054 B2 * 10/2006 Shock ..... E04G 23/0203 52/514.5
7,836,659 B1 11/2010 Barnes et al.
8,661,758 B2 * 3/2014 Longhenry ..... E04G 23/0203 264/46.4
8,959,873 B2 * 2/2015 Longhenry ..... E04G 23/0203 264/46.4
9,410,335 B2 * 8/2016 Stubblefield ..... E04G 23/0203
2004/0055237 A1 * 3/2004 Bravinski ..... E04B 2/8647 52/426
2005/0284090 A1 * 12/2005 Bravinski ..... E04B 2/8647 52/742.14
2009/0320391 A1 12/2009 Stubblefield et al.
2011/0192104 A1 8/2011 Longhenry et al.
2011/0239577 A1 * 10/2011 Hansen ..... E04G 23/0203 52/514
2015/0259942 A1 * 9/2015 Crichlow ..... E04H 9/14 52/79.1
2015/0345101 A1 * 12/2015 Kent ..... E02D 27/08 52/633

* cited by examiner

HOLE REPAIR

FIELD

Various exemplary embodiments of a hole repair assembly and methods of repairing holes are described herein.

BACKGROUND

It is often necessary to drill or form core holes in concrete floor slabs. For example, it may be necessary to carry out repairs on conduits in the slabs or to carry out inspections. It can be difficult to repair the holes afterwards. Various forms of shuttering can be used together with a settable material. However, the result tends to be unsightly. Furthermore, the settable material and the concrete of the slab are generally not homogenous once the settable material has set in the hole. Thus, a plug of the material can be pushed out of the hole and fall onto the floor below. This might happen when a vehicle or some other bad passes over the hole.

SUMMARY

Various exemplary embodiments of a hole repair assembly comprise a support;

a connector that is fastenable to the support;

a closure for connection to the support with the connector, the support, connector and closure being configured so that the support and the closure can be connected and spaced from each other with the connector; and one or more retaining members arranged on one or both of the support and the connector to extend from the connector.

The connector may be elongate. A distal end of the connector may be fastenable to the support. The closure may be connectable to the support with the connector at or near a proximal end of the connector, and the retaining members extending from a longitudinal axis of the connector.

The elongate connector may be a round bar, the support including a socket or socket member that opens on a proximal side of the support so that the distal end of the connector can be secured in the socket or socket member.

The connector may be threaded. The socket or socket member may be internally threaded so that the distal end of the connector can be secured by being screwed into the socket or socket member.

The support may include a support element, the socket member being fastened to a proximal side of the support element.

The closure may define an opening through which the connector passes so that a threaded fastener can be threaded onto the proximal end of the connector to retain the closure on the connector.

Two or more retaining bars may be mounted on one or both of the support member and the elongate connector. The retaining bars may each be curved, with a distal region generally parallel to the connector and a proximal region curved or bent away from the connector.

At least a portion of the distal region of each retaining bar may be fastened to the socket member.

Various exemplary embodiments of a method of repairing a hole in a structural component with the repair assembly described above comprise the steps of:

positioning the support to overlie the hole on a distal side of the structural component;

positioning the closure over the hole on a proximal side of the structural component;

securing the closure against the proximal side of the structural component by fastening the connector to both the closure and the support; and at least partially filing a volume between the closure and the support with a settable material.

Various exemplary embodiments of a hole repair assembly comprise a support;

a connector that is fastenable to the support; and one or more retaining members arranged on one or both of the support and the connector to extend from the connector, the connector being configured to that a closure can be connected to the support with the connector, so that the support and the closure can be spaced from each other with the connector.

Various exemplary embodiments of a hole repair assembly comprise a support that includes a support element and a socket member that is fastened to a distal side of the support element, the socket member having an internally threaded socket;

an elongate threaded connector with a distal end that can be threaded into or out of the socket member;

a closure that defines an opening to accommodate the threaded connector so that a fastener can be threaded onto a proximal end of the threaded connector to connect the closure and the support in a spaced manner; and one or more retaining members arranged on one or both of the support and the connector to extend from the connector.

Various exemplary embodiments of a hole repair assembly comprise one or more of the support, connector, closure and retaining member(s) supplied separately or in any combination.

Various exemplary embodiments of a hole repair assembly comprise a kit of the support, connector, closure and retaining member(s) supplied separately or in any combination, for the purposes of assembly by an installer or other user.

DESCRIPTION OF THE EMBODIMENTS

Figure 1:
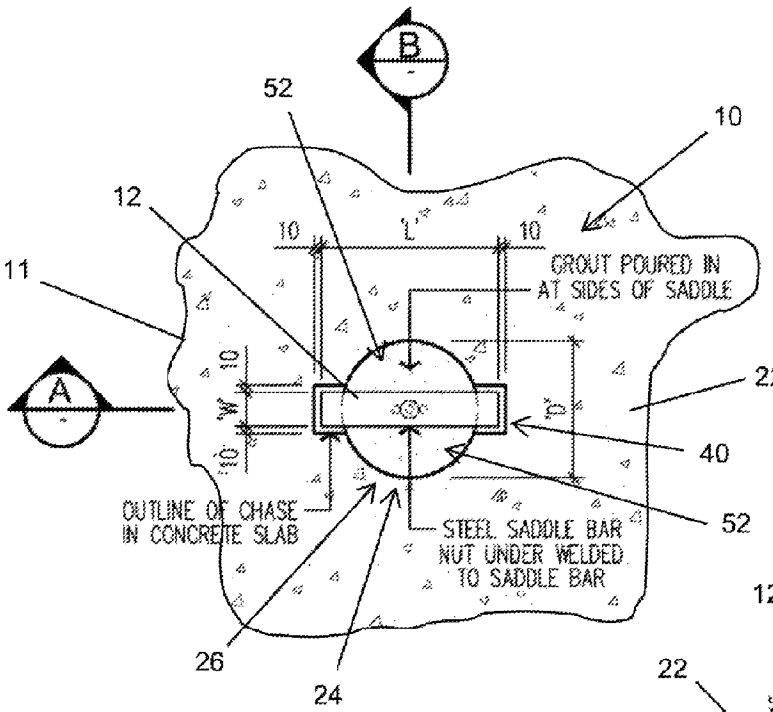
FIG. 1 shows a plan view of an exemplary embodiment of a hole repair assembly.
Figure 2:
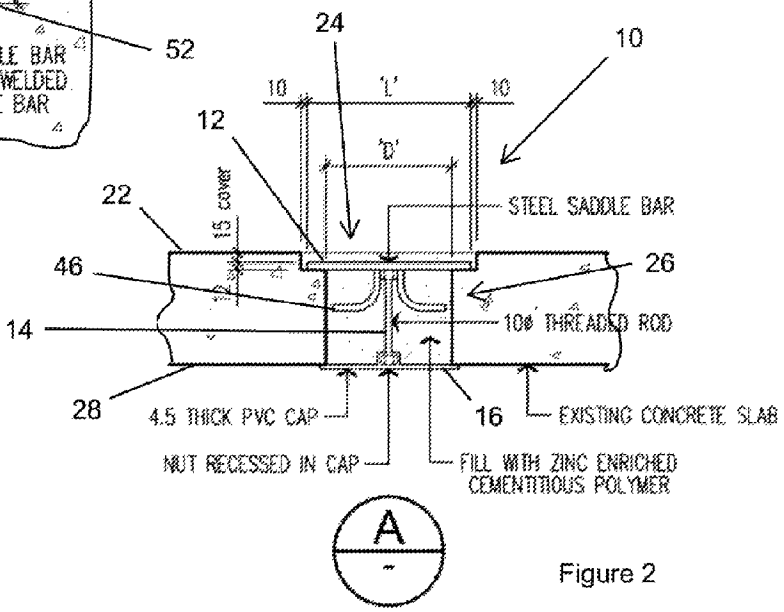
FIG. 2 shows a schematic side sectioned view through A in FIG. 1.

In the drawings, reference numeral 10 generally indicates an exemplary embodiment of a hole repair assembly.

The hole repair assembly 10 can be used for repairing structural components such as concrete floor slabs 11. However, it is envisaged that the assembly 10 can be used for repairing other structural components.

The repair assembly 10 includes a support in the form of an elongate support element 12. The support element 12 is in the form of an elongate bar that is generally flat and rectangular in cross section. Other configurations may also be suitable. The support element 12 can be in the form of a metal bar or plate. For example, the bar or plate can be of galvanised steel.

The repair assembly 10 includes an elongate connector 14 that is fastenable at a distal end 32 to the support element 12. In this example, the elongate connector 14 is a threaded rod. However, in other examples, the elongate connector 14 can be smooth bar or even a length of reinforcing bar.

The assembly 10 includes a closure member or closure 16. The closure 16 and the connector 14 are configured so that the closure 16 can be connected to the support element 12 with the connector 14 at or near a proximal end 18 of the connector 14 so that the closure 16 is spaced from the support element. The closure 16 can be a closure plate of any particular shape. Furthermore, the closure 16 can be of any number of different materials. For example, the closure 16 can be of a material that is suitable for shuttering. In one example, the closure 16 can be of a plastics material. In a particular example, the closure 16 can be of a polyvinyl chloride (PVC) material. The closure 16 can have a thickness of between about 3 mm and 6 mm, for example, 4.5 mm.

The support element 12, the closure 16 and the connector 14 are configured to suit a predetermined range of hole sizes and slab thicknesses. In one example, the connector 14 can be of a length which would allow it to extend through holes in slabs having a range of thicknesses. In that example, an installer can simply cut the connector 14 to length.

More particularly, the support element 12 is dimensioned to overlie a distal surface 22 of the slab 11 and to span a distal opening 24 of a hole 26. The closure 16 is dimensioned to overlie a proximal surface 28 of the slab 11 about a proximal opening 30 of the hole 26.

The support element 12 includes a socket that can accommodate the connector 14 to secure the distal end 32 of the connector 14 to the support element 12. In this example, a socket member 34 is mounted on a proximal surface 36 of the support element 12 to define the socket. The socket member 34 has an internal thread. Where the connector 14 is in the form of a threaded rod or bar, the proximal end 18 of the connector 14 can be threaded into the socket member 34 to secure the connector 14 to the support element 12.

The closure 16 defines an opening 20 to accommodate the connector 14. In particular, when the support element 12 is supported on the distal surface 22 and the connector 14 is secured to the socket member 34, the closure 16 can be pressed up against the proximal surface 28 with the connector 14 extending from the closure 16. In that position, the closure 16 can close the proximal opening 30.

A nut 38 can be threaded on to the connector 14 to secure the closure 16 on an outer side of the closure 16 by butting up against the closure 16 as it is threaded on to the connector 14. The closure 16 defines a recess or countersunk formation 54 to accommodate the nut 38. For example, the closure 16 is shaped so that the nut 38 is flush with the closure 16.

The connector 14 is of steel. The steel can be galvanised. The connector 14 can have a diameter of between about 8 mm and 12 mm, for example 10 mm. Other diameters can also be suitable, depending on the application.

The support element 12 is dimensioned to span or straddle the distal opening 24.

Prior to positioning the support element 12, diametrically opposed radial channels 40 can be formed or chased into the slab 11 to accommodate end portions 42 of the support element 12. The channels 40 are formed so that the support element 12 is positioned below the distal surface 22 of the slab 11.

The support element 12 can have a thickness of between about 10 mm and 18 mm, for example, about 12 mm. Each of the channels 40 can have a depth of between about 25 mm and 30 mm, for example, about 27 mm. The support element 12 can clear sides of the channels 40 by between about 5 mm and 15 mm, for example, about 10 mm. This allows a settable material to fill those clearance zones, which is structurally desirable.

Figure 3:
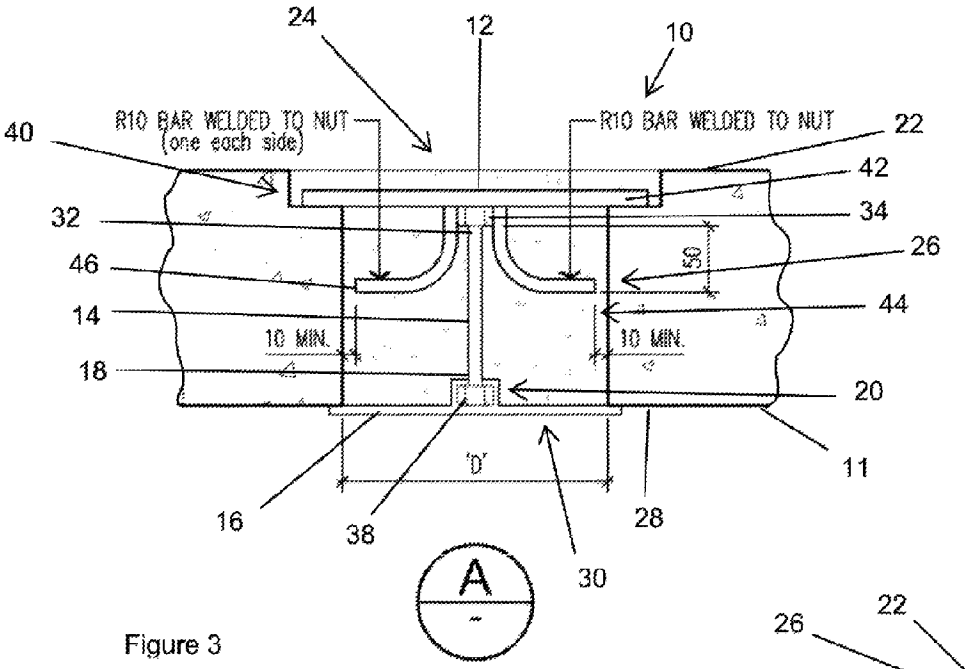
FIG. 3 shows another schematic side sectioned view through A in FIG. 1.
Figure 4:
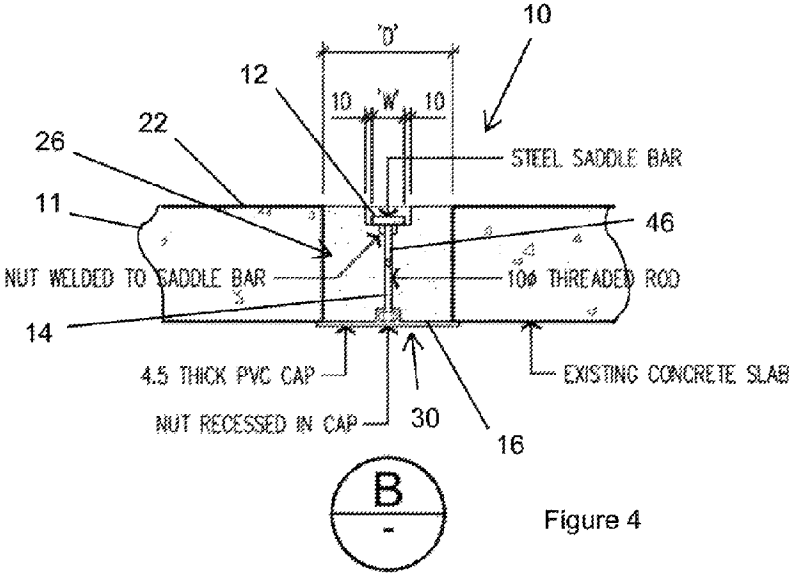
FIG. 4 shows a schematic side sectioned view through B in FIG. 1.
Figure 5:
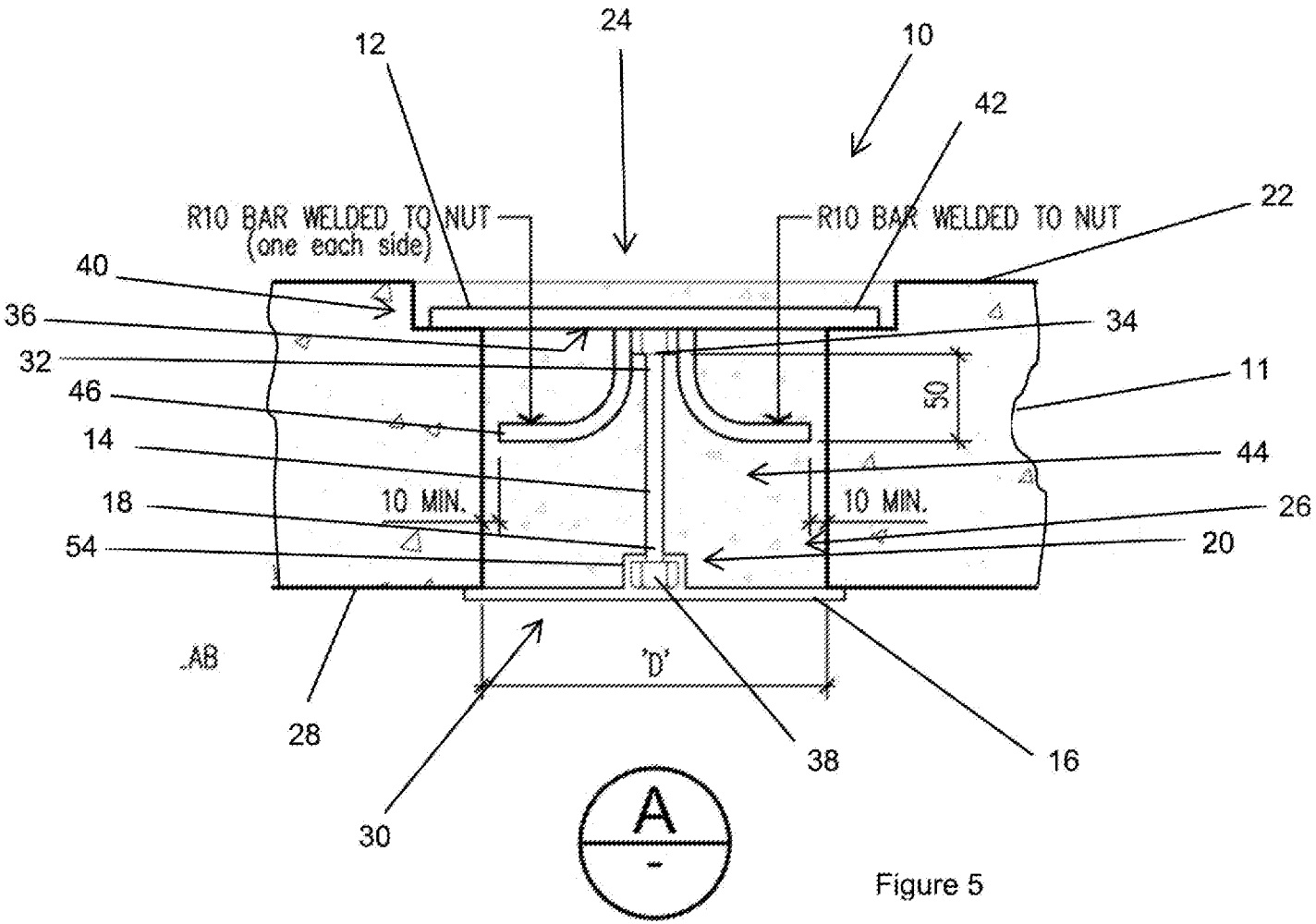
FIG. 5 shows a more detailed schematic side sectioned view through A in FIG. 1.

The socket member 34 is fastened to the support element 12 (FIG. 3), about halfway between the end portions 42 of the support element 12. The socket member 34 can be of steel and can be welded or otherwise secured to the proximal surface 28 of the support element 12.

One or more retaining members 46 are fastened to one or both of the support element 12 and the socket member 34 to extend from a longitudinal axis of the connector 14 and into a volume 44 between the support element 12 and the closure 14. In this example, two retaining members 46 extend generally radially from the longitudinal axis of the connector 14.

Each of the retaining members 46 is in the form of an elongate retaining bar that is curved to define a distal portion 48 and a proximal portion 50. The distal portions 48 are fastened to the socket member 34 to extend at least partially generally parallel to the longitudinal axis of the connector 14, the proximal portions 50 extending generally radially with respect to the longitudinal axis of the connector 14.

The retaining members 46 are in the form of steel bars that are bent or otherwise shaped to form the distal and proximal portions 48, 50. The retaining members 46 are mounted in alignment with each other so that they extended diametrically with respect to the longitudinal axis of the connector 14. In one example, the retaining members 46 are in the form of reinforcing bars, such as those used for reinforcing concrete. The retaining member 46 have a radius of between about 8 mm and 12 mm, for example, 10 mm.

Thus, as can be seen in the drawings, the retaining member 46 extend initially downwardly from the socket member 34 before extending towards sides of the hole 26 to terminate a minimum of about 10 mm from the sides. The retaining members 46 can extend downwardly for about 50 mm, in one example.

The socket member 34 has at least two opposed flat faces to facilitate connection of the retaining members 46 to the socket member 34, by welding, for example. The socket member 34 can be nut-shaped to define the flat faces.

Core holes are generally cylindrical. The support element 12 is dimensioned so that part-hemispherical openings 52 (FIG. 1) are formed on respective sides of the support element 12 when secured to the closure 16. A settable material can be poured into the volume 44 via these openings 52. That settable material can be concrete or a grouting material. For example, that settable material can be a zinc enriched cementitious polymer. That can serve to preserve the connector 14 and the support element 12 from corrosion.

The settable material can be used to fill the volume 44 and can also be poured over the support element 12 to be flush with the distal surface 22 of the slab 11. Thus, once set, the hole 26 is largely indiscernible from the distal surface 22.

At a proximal side of the slab 11, the nut 38 can be unscrewed and the closure 16 removed once the material has set. A resultant recess caused by the countersunk formation 54 can simply be filled. Thus, the hole 26 is largely indiscernible from the proximal side.

Set out below is a table showing possible relative dimensions of the core hole 16 and the support element 12

| Core Hole Diameter (mm) | Support element Width (mm) | Support element Length (mm) | Support element Thickness (mm) |
|---|---|---|---|
| 50 to 70 | 20 | 110 | 12 |
| 70 to 125 | 30 | 180 | 12 |
| 125 to 200 | 50 | 260 | 12 |
| 150 to 200 | 80 | 270 | 12 |

It is submitted that a person of ordinary skill in the field could readily determine suitable dimensions for the support element 12 for a range of hole diameters using the above table. The above table also provides an indication of the extent to which the retaining members 46 can extend from the connector 14

It has been found that an area defined by a core hole, repaired as described above, can withstand a concentrated load in excess of 7.5 KN.

Figure 6:
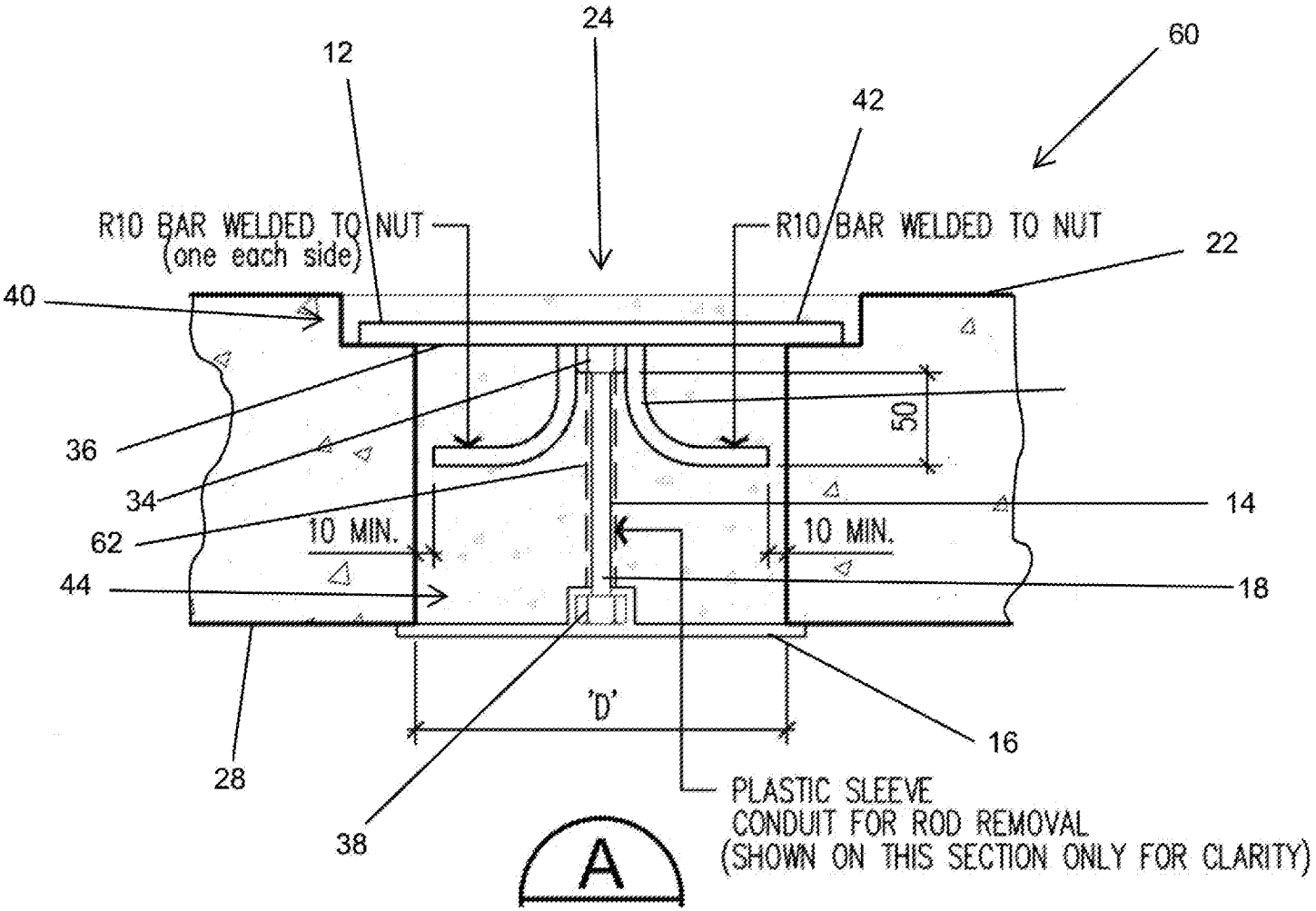
FIG. 6 shows a schematic side sectioned view of another exemplary embodiment of a hole repair assembly.
Figure 7:
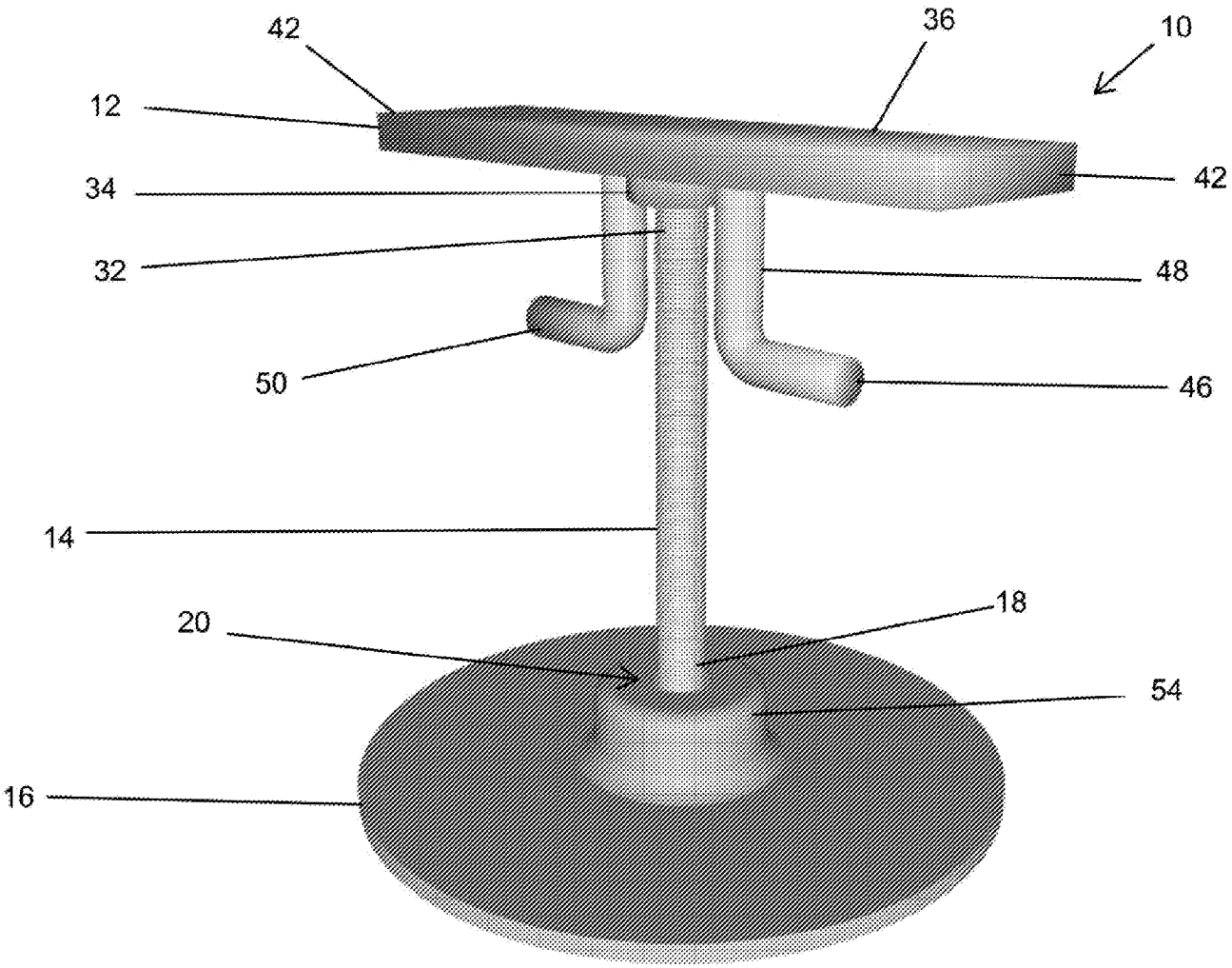
FIG. 7 shows a three dimensional view of the hole repair assembly of FIGS. 2 to 4.

In FIG. 6, reference numeral 60 generally indicates another exemplary embodiment of a hole repair assembly. With reference to FIGS. 1 to 5, like reference numerals refer to like parts, unless otherwise specified. However, common use of reference numerals is not intended to limit the scope of the appended claims. Furthermore, where practical, components of the assembles 10, 60 can be interchanged without departing from the scope of the appended claims.

The hole repair assembly includes a sleeve 62 that can be placed over the connector 14 prior to the closure 16 being secured in position. This allows the connector 14 to be unscrewed from the socket member 34 once the concrete has set. As a result, when the closure 14 is removed, the settable material is finished flush with the surface 28, without interference by the support element 12.

The sleeve 62 can be of a plastics material. For example, the sleeve 62 can be a length of conduit or pipe.

The assembly 10, 60 is provided in a kit form to suit various hole diameters, for example, such as those set out in the above table.

In use, the support element 12 is positioned on the distal surface 22 and a marker is used to make an outline of the end portions 42 of the support element 12 that overlie the surface 22 with the remainder of the support element 12 spanning the distal opening 24. The marking is carried out so as to provide a clearance around the portions 42. For example, the clearance can be about 10 mm.

The marked area is then chased out to the required depth, as set out above, for example, between about 25 mm and 30 mm, for example, about 27 mm, to define the radial channels 40.

A distance between the proximal surface 28 of the slab 11 and a floor or bed of the radial channels 40 is measured and the connector 14 is cut to size.

The distal end 32 of the connector 14 is then threaded into the socket member 34 to secure the connector 14 to the support element 12.

A bead of silicone or a similar product can be applied about a periphery of the closure 16. The closure 16 is then positioned against the proximal surface 28 of the slab 11 with the proximal end 18 of the connector 14 extending through the closure 16. The nut 38 is threaded onto the proximal end 18 to secure the closure 16 against the proximal surface 28.

The grout or cementitious material is then poured through the hemispherical openings 52 to at least partially fill the volume 44. The rest of the volume 44 is then finished off with the grout or cementitious material using a trowel or the like to provide a surface that is flush with the distal surface of the slab 11.

Once the cementitious material or grout has set, the nut 38 can be unscrewed and the closure removed. Also, particularly with the assembly 60, the connector 14 can be unscrewed from the socket member 34 and removed. The resultant area about the proximal opening 30 can be plastered with the grout or cementitious material to provide a surface that is flush with the proximal surface 28 of the slab 11.

Thus, once the above process is complete, there is provided a plug for the core hole that is largely indiscernible. Also, as a result of the support element 12 and the retaining members 46, the plug and the remainder of the slab 11 define a zone that is substantially homogenous as far as strength is concerned. In other words, the process results in the substantial reinstatement or re-constitution of the slab 11 without the core hole 26. The reason for this is that the plug is retained in the hole 26 by the support element 12 resting in the channels 40 and the retaining members 46 extending into the volume 44 and thus the plug.

Throughout the specification, including the claims, the words "proximal" and "distal" have no specific meaning apart from identifying opposite orientations relative to the structural component. In this case, "proximal" relates to an approach from that side of the structural component on which the closure member is positioned. "Distal" relates to an approach from that side of the structural component on which the support member is positioned.

Throughout the specification, including the claims, the word "support" and derivatives is to be given a meaning that is not dependent on the orientation of the component or article being supported. Thus, the article or component can be hung or depend from the support member or can be carried on the support member.

Throughout the specification, including the claims, the word "connector" includes any device, article or contrivance that is used for connecting two components or articles together. It need not be a separate component in and of itself and can form a unitary structure together with either or both of the components that are connected.

Throughout the specification, including the claims, the word "repair" and derivatives includes, but is not limited to, performing operations relating to the correction of damage. For example, a hole may be created for some use that has become redundant. The word "repair" encompasses operations that including restoring the structural component to a condition in which the structural component was before the hole was made. It also encompasses operations that include improving or enhancing a condition of the structural component and even mounting other components to the structural component.

Throughout the specification, including the claims, the word "retain" and derivatives includes, but is not limited to, the action or operation of keeping an article or component in a position relative to other articles or components.

Throughout the specification, including the claims, the verb "position" and its derivatives includes, but is not limited to, placing an article or component in a location that is not necessarily predetermined. In other words, simply moving the article or component from one place or location to another, general, unspecific place or location is encompassed by the verb "position". The noun "position" and its derivatives is to be given the same consideration.

Throughout the specification, including the claims, the verb "secure" and its derivatives includes, but is not limited to, holding a component or article in a place or position in a non-locking, removable or detachable manner.

Throughout the specification, including the claims, the word "closure" includes, but is not limited to, an article, component or contrivance that can substantially close an opening and not necessarily in a sealed manner.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

Variations (e.g., modifications and/or enhancements) of one or more embodiments described herein might become apparent to those of ordinary skill in the art upon reading this specification. The inventor(s) expect skilled artisans to employ such variations as appropriate, and the inventor(s) intend for the claimed subject matter to be practiced other than as specifically described herein. Accordingly, as permitted by law, the claimed subject matter includes and covers all equivalents of the claimed subject matter and al improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of words that indicate orientation or direction of travel is not to be considered limiting. Thus, words such as "above", "below", "front", "back", "rear", "side", "up", "down", "upper", "lower", "top", "bottom", "forwards", "backwards", "towards", "distal", "proximal" "in", "out", "under", "over" and synonyms, antonyms and derivatives thereof have been selected for convenience only, unless the context indicates otherwise. The inventor envisages that various exemplary embodiments of the claimed subject matter can be supplied in any particular orientation and the claimed subject matter is intended to include such orientations.

Thus, regardless of the content of any portion of this specification, unless clearly specified to the contrary, or dearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;

b. no characteristic, function, activity, or element is "essential";

c. any elements can be integrated, segregated, and/or duplicated;

d. any activity can be repeated, any activity can be performed by multiple entities, and/or any activity can be performed in multiple jurisdictions; and e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, bit not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. A hole repair assembly, comprising:

a support;

an elongate connector that is fastenable, at a distal end, to the support;

a closure for connection to the support with the connector, the closure being connectable to the support with the connector at or near a proximal end of the connector, wherein the support, connector and closure are configured so that the support and the closure can be connected and spaced from each other with the connector to define a volume between the support and the closure into which a settable material can be poured; and one or more elongate retaining bars arranged on one or both of the support and the connector to extend from a longitudinal axis of the connector and into the volume so that, once the settable material has set, the closure can be removed with a plug being retained in the volume by the support and the retaining bars, wherein the support and the closure are configured so that, once the settable material has set, the set material is flush with a surface of the structural component.

2. The hole repair assembly as claimed in claim 1, in which the elongate connector is a round bar, the support including a socket or socket member that opens on a proximal side of the support so that the distal end of the connector can be secured in the socket or socket member.

3. The hole repair assembly as claimed in claim 2, in which the connector is threaded and the socket or socket member is internally threaded so that the distal end of the connector can be secured by being screwed into the socket or socket member.

4. The hole repair assembly as claimed in claim 3, in which the support includes a support element, the socket member being fastened to a proximal side of the support element.

5. The hole repair assembly as claimed in claim 4, in which the closure defines an opening through which the connector passes so that a threaded fastener can be threaded onto the proximal end of the connector to retain the closure on the connector.

6. The hole repair assembly as claimed in claim 4, in which two or more retaining bars are mounted on one or both of the support member and the elongate connector and the retaining bars are each curved, with a distal portion generally parallel to the connector and a proximal portion curved or bent away from the connector.

7. The hole repair assembly as claimed in claim 6, in which at least a portion of the distal region of each retaining bar is fastened to the socket member.

8. The hole repair assembly as claimed in claim 2, in which the support includes a support element, the socket member being fastened to a proximal side of the support element.

9. The hole repair assembly as claimed in claim 1, in which two or more retaining bars are mounted on one or both of the support member and the elongate connector.

10. The hole repair assembly as claimed in claim 1, in which two or more retaining bars are mounted on one or both of the support and the connector and the retaining bars are each curved, with a distal region generally parallel to the connector and a proximal region curved or bent away from the connector.

11. The hole repair assembly as claimed in claim 1, in which the, or each, elongate retaining bar depends from the support.

12. A method of repairing a hole in a structural component, the method comprising the steps of:

providing a hole repair assembly, the hole repair assembly including:

a support;

an elongate connector that is fastenable, at a distal end, to the support;

a closure for connection to the support with the connector, the closure being connectable to the support with the connector at or near a proximal end of the connector, wherein the support, connector and closure are configured so that the support and the closure can be connected and spaced from each other with the connector to define a volume between the support and the closure into which a settable material can be poured; and one or more elongate retaining bars arranged on one or both of the support and the connector to extend from a longitudinal axis of the connector and into the volume so that, once the settable material has set, the closure can be removed with a plug being retained in the volume by the support and the retaining bars, wherein the support and the closure are configured so that, once the settable material has set, the set material is flush with a surface of the structural component;

positioning the support to overlie the hole on a distal side of the structural component;

positioning the closure over the hole on a proximal side of the structural component;

securing the closure against the proximal side of the structural component by fastening the connector to both the closure and the support; and at least partially filling a volume between the closure and the support with a settable material.

13. The method as claimed in claim 12, which includes positioning the support in channels formed in the structural component.

14. The method as claimed in claim 13, which includes forming the channels in the structural component such that the support can be positioned below a distal surface of the structural component.

15. The method as claimed in claim 12, in which the, or each, elongate retaining bar depends from the support.

* * * * *